US008696836B2

(12) United States Patent
Takahata et al.

(10) Patent No.: US 8,696,836 B2
(45) Date of Patent: Apr. 15, 2014

(54) NONMAGNETIC HIGH-HARDNESS ALLOY

(75) Inventors: Noritaka Takahata, Nagoya (JP); Michiharu Ogawa, Nagoya (JP); Shigeki Ueta, Nagoya (JP); Tetsuya Shimizu, Nagoya (JP)

(73) Assignee: Daido Tokushuko Kabushiki Kaisha, Nagoya-Shi, Aichi (JP)

( * ) Notice: Subject to any disclaimer, the term of this patent is extended or adjusted under 35 U.S.C. 154(b) by 792 days.

(21) Appl. No.: 11/365,511

(22) Filed: Mar. 2, 2006

(65) Prior Publication Data

US 2006/0207696 A1 Sep. 21, 2006

(30) Foreign Application Priority Data

Mar. 3, 2005 (JP) ..... P.2005-059279
Jan. 20, 2006 (JP) ..... P.2006-012931

(51) Int. Cl.
*C22F 1/10* (2006.01)
*C22C 19/05* (2006.01)

(52) U.S. Cl.
USPC ..... 148/677; 148/410

(58) Field of Classification Search
USPC ..... 420/445; 148/410, 677
See application file for complete search history.

(56) References Cited

U.S. PATENT DOCUMENTS

| | | | | | |
|---|---|---|---|---|---|
| 1,993,600 | A | * | 3/1935 | Owens et al. | 72/38 |
| 2,570,194 | A | * | 10/1951 | Sumpter et al. | 148/675 |
| 3,015,558 | A | * | 1/1962 | Grant et al. | 420/445 |
| 3,565,611 | A | * | 2/1971 | Economy | 420/445 |
| 4,155,782 | A | * | 5/1979 | Shimotori et al. | 148/410 |
| 4,478,064 | A | * | 10/1984 | Brenneman | 72/232 |
| 4,798,632 | A | * | 1/1989 | Yonezawa et al. | 148/675 |
| 5,858,558 | A | | 1/1999 | Zhao et al. | |
| 6,623,869 | B1 | | 9/2003 | Nishiyama et al. | |

FOREIGN PATENT DOCUMENTS

| | | | | |
|---|---|---|---|---|
| EP | 1505166 | | 2/2005 | |
| JP | 08-067940 | * | 3/1996 | C22C 30/00 |
| JP | 2000-345267 | | 12/2000 | |
| JP | 2001-062595 | | 3/2001 | |
| JP | 2002-069557 | | 3/2002 | |
| JP | 2002-69557 | | 3/2002 | |
| JP | 2002-088431 | * | 3/2002 | |
| WO | 03097887 | | 11/2003 | |

OTHER PUBLICATIONS

Zhang Su Xia, et al., "Precision Forging of Small Net Shape Component—Reduction of Forming Pressure through Tool Design", SIMTech Technical Report (PT/01/039/PMF), 2001, pp. 1-9.*
Waters, T.F., Fundamentals of Manufacturing for Engineers, "Cold Drawing", Taylor & Francis Group, 2001, pp. 61-63.*
Abstract and English Machine Translation of Hamanaka, et al. (JP 08-067940) (1996).*
Abstract and English Machine Translation of Ueda, et al. (JP 2002-069557) (2002).*
English Abstract of Shimojima et al. (JP 53-061515) (1978).*
English Abstract of Kitazawa et al. (JP 2002-363673) (2002).*
English Abstract of Takahata et al. (JP 2003-253362) (2003).*
Notification of Reasons for Refusal for Patent Application 2006-012931 dated May 27, 2011.

* cited by examiner

*Primary Examiner* — Jessee Roe
(74) *Attorney, Agent, or Firm* — Bacon & Thomas, PLLC

(57) ABSTRACT

The present invention provides a nonmagnetic high-hardness alloy having a Ni-based alloy composition containing; by weight %, C of 0.1% or less: Si of 2.0% or less; Mn of 2.0% or less; P of 0.03% or less; S of 0.01% or less; Cr of 30 to 45%; Al of 1.5 to 5.0%; and a balance of unavoidable impurities and Ni, the nonmagnetic high-hardness alloy being subjected to cold or warm plastic working and then ageing treatment, and a method for producing the nonmagnetic high-hardness alloy.

12 Claims, 3 Drawing Sheets

NONMAGNETIC HIGH-HARDNESS ALLOY

FIELD OF THE INVENTION

The present invention relates to a nonmagnetic high-hardness alloy comprising a nickel-based alloy with excellent in wear resistance and corrosion resistance.

BACKGROUND OF THE INVENTION

Not only high-hardness, but also nonmagnetic property and high corrosion resistance are required for parts that need wear resistance and are applied to, electronic industries such as machine parts, precision parts and molds, which are used in magnetic atmosphere.

The JIS SUH660 steel, titanium alloys or copper alloys, etc. are applied for the machine parts, but their hardness or corrosion resistance are not sufficient, and so far there have been no material that satisfies nonmagnetic, high corrosion resistance and high hardness.

There has been proposed nickel-based high-hardness alloys containing 0.1% (by weight) or less of carbon (C), 2.0% (by weight) or less of silicon (Si), 2.0% (by weight) or less of manganese (Mn), 30 to 45% (by weight) of chromium (Cr), 1.5 to 5.0% (by weight) of aluminum (Al), and the balance being unavoidable impurities and nickel (Ni), the alloy being strengthened by the composite precipitation of γ' (gamma prime: $Ni_3Al$) phase and ECr (alpha-chromium) phase, as described in Reference 1.

[Reference 1] JP2002-69557A

The existent nickel-based high-hardness alloys of the Reference 1 are non-magnetic and have an enhanced corrosion resistance owing to the addition of chromium but its hardness is at most 600 to 720 HV and therefore the wear resistance is not sufficient yet. Furthermore, it has required at least 16 hours of ageing treatment to get suitable high hardness and over at least 24 hours of ageing treatment to get the maximum hardness.

SUMMARY OF THE INVENTION

The present invention has been conducted under these circumstances, and an object is to provide nonmagnetic high-hardness alloys with excellent corrosion resistance.

The present inventors have made eager investigation to solve the problem. As results, it has been found that it is possible for the nickel based alloy to obtain a drastically higher hardness than ever, as well as corrosion resistance and nonmagnetic property by cold or warm plastic working and direct ageing without strain release annealing for shorter ageing treatment only from 4 to 24 hours at 350 to 700° C. at which the strain release is difficult. This is based on our discovery of new fact that the precipitation of γ' phase in the grain increases amount of chromium in the matrix relatively and enhances the precipitation of αCr which initiates on the grain boundary. Cold or warm plastic working has both effects that it produces strain and thereby promotes the precipitation of γ' phase in the grain while it also makes the gain size small and thereby the precipitation of αCr can cover the grains, in a shorter time.

The present invention is mainly directed to the following items:

1. A nonmagnetic high-hardness alloy having Ni-based alloy composition containing; by weight %, C of 0.1% or less: Si of 2.0% or less; Mn of 2.0% or less; P of 0.03% or less; S of 0.01% or less; Cr of 30 to 45%; Al of 1.5 to 5.0%; and a balance of unavoidable impurities and Ni, the nonmagnetic high-hardness alloy being subjected to cold or warm plastic working and then direct ageing treatment.

2. The nonmagnetic high-hardness alloy according to item 1, wherein the Ni-based alloy composition further contains, by weight %, at least one of: Ti of 3.0% or less, Zr of 3.0% or less, and Hf of 3.0% or less, satisfying the relationship Ti+Zr+Hf of 3.0% or less; Nb of 3.0% or less, Ta of 3.0% or less, and V of 3.0% or less, satisfying the relationship Nb+Ta+V of 3.0% or less; Co of 10% or less; Mo of 10% or less, and W of 10% or less, satisfying the relationship Mo+0.5 W of 10% or less; Cu of 5% or less; B of 0.015% or less; Mg of 0.01% or less; Ca of 0.01% or less; REM (rare earth metal) of 0.1% or less; and Fe of 5% or less.

3. The nonmagnetic high-hardness alloy according to item 1, wherein the cold or warm plastic working rate is 15% or higher.

4. The nonmagnetic high-hardness alloy according to any of item 1, wherein the ageing treatment is performed at 350 to 700° C. for 4 to 24 hours, while strain produced by the cold or warm plastic working remains.

5. A method for producing nonmagnetic high-hardness alloy, comprising; preparing a material having Ni-based alloy composition containing; by weight %, C of 0.1% or less: Si of 2.0% or less; Mn of 2.0% or less; P of 0.03% or less; S of 0.01% or less; Cr of 30 to 45%; Al of 1.5 to 5.0%; and a balance of unavoidable impurities and Ni; subjecting the material to cold or warm plastic working with predetermined working rate to obtain a plastically worked material; and then subjecting the plastically worked material to ageing treatment at predetermined temperature for predetermined time.

6. The method for producing nonmagnetic high-hardness alloy according to item 5, wherein the Ni-based alloy composition further contains, by weight %, at least one of: Ti of 3.0% or less, Zr of 3.0% or less, and Hf of 3.0% or less, satisfying the relationship Ti+Zr+Hf of 3.0% or less; Nb of 3.0% or less, Ta of 3.0% or less, and V of 3.0% or less, satisfying the relationship Nb+Ta+V of 3.0% or less; Co of 10% or less; Mo of 10% or less, and W of 10% or less, satisfying the relationship Mo+0.5 W of 10% or less; Cu of 5% or less; B of 0.015% or less; Mg of 0.01% or less; Ca of 0.01% or less; REM (rare earth metal) of 0.1% or less; and Fe of 5% or less.

DETAILED DESCRIPTION OF THE INVENTION

Figure 1:
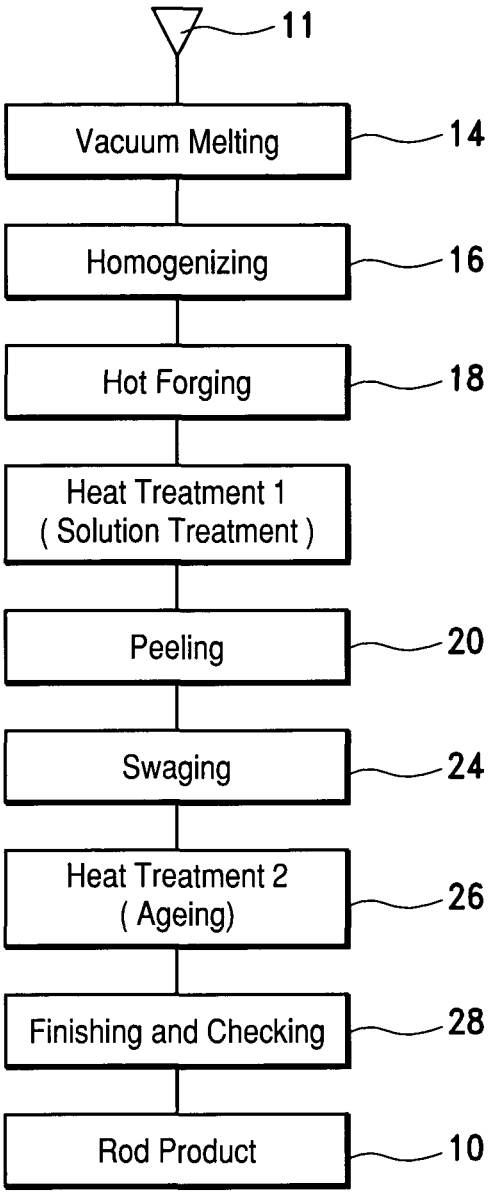
FIG. 1 is a flowchart illustrating a process of manufacturing rods according to certain example of the present invention.
Figure 2:
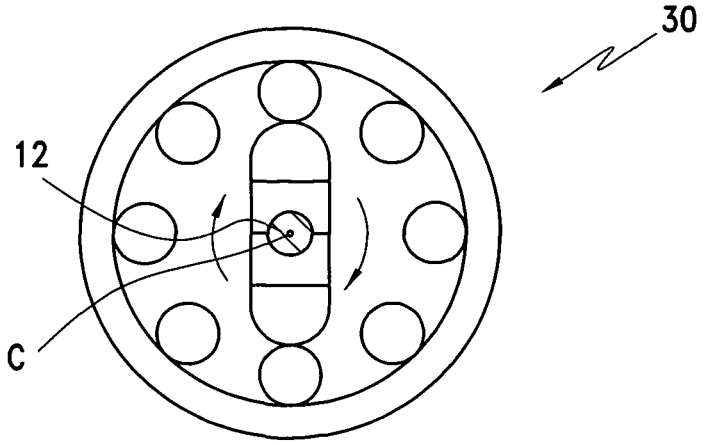
FIG. 2 is a diagram illustrating an apparatus used for the swaging process in the flowchart of FIG. 1 and is a simplified sectional view of the apparatus 30 as taken from a normal plane to its longitudinal axis.
Figure 3:
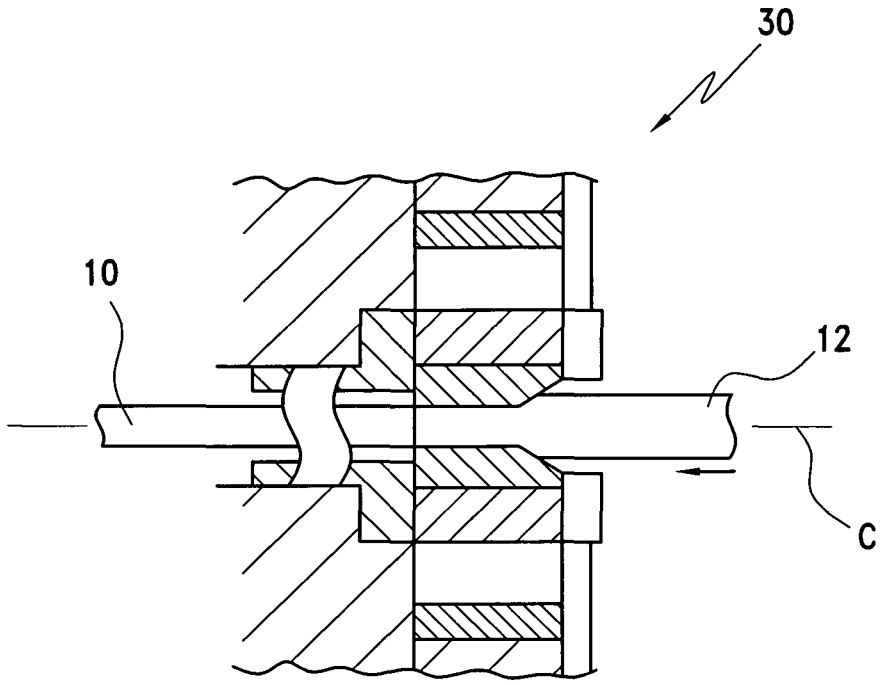
FIG. 3 is a schematic sectional view of the swaging apparatus of FIG. 2 as taken along its longitudinal axis C.

The nonmagnetic high-hardness alloy according to first aspect of the present invention has a sufficient higher hardness than the original material owing to its cold or warm plastic working and subsequent ageing treatment. It has low magnetic permeability, since the basical composition of this alloy mainly contains nickel. Its magnetic permeability is not increased by cold or warm plastic working as in the case of austenitic stainless steel represented by JIS SUS304. It has excellent corrosion resistance, since the composition contains 30 to 45% (by weight) of chromium. Moreover, it can be manufactured at relatively low cost, since the Ni-based alloy composition does not contain any expensive metals.

The nonmagnetic high-hardness alloy according to second aspect of the present invention exhibits improvements in properties corresponding to effects of each composition, since the Ni-based alloy composition further contains at least one of: Ti of 3.0% (by weight) or less, Zr of 3.0% (by weight) or less, and Hf of 3.0% (by weight) or less, satisfying the relationship Ti+Zr+Hf of 3.0% (by weight) or less; Nb of 3.0% (by weight) or less, Ta of 3.0% (by weight) or less, and V of 3.0% (by weight) or less, satisfying the relationship Nb+Ta+V of 3.0% (by weight) or less; Co of 10% (by weight) or less; Mo of 10% (by weight) or less, and W of 10% (by weight) or less, satisfying the relationship Mo+0.5 W of 10% (by weight) or less; Cu of 5% (by weight) or less; B of 0.015% (by weight) or less; Mg of 0.01% (by weight) or less; Ca of 0.01% (by weight) or less; REM (rare earth metal) of 0.1% (by weight) or less; and Fe of 5% (by weight) or less.

According to third aspect of the present invention, the hardness of the nonmagnetic high-hardness alloy remarkably increases by ageing treatment, since the precedent plastic working at a working rate of 15% or higher is carried out.

According to fourth aspect of the present invention, the hardness of the nonmagnetic high-hardness alloy remarkably increases by ageing treatment, since very fine precipitates in size of 10 μm or less are formed when the ageing treatment is performed at 350 to 700° C. for 4 to 24 hours, while strain produced by the plastic working still remains.

The method of manufacturing nonmagnetic high-hardness alloy according to a fifth aspect of the present invention provides an alloy having a sufficient higher hardness than the base material by preparing a material having a Ni-based alloy composition containing, by weight %: 0.1% or less C; 2.0% or less Si; 2.0% or less Mn; 0.03% or less P; 0.01% or less S; 30 to 45% Cr; 1.5 to 5.0% Al; and a balance of unavoidable impurities and Ni; subjecting the alloy to cold or warm plastic working at a predetermined working rate to obtain a plastically worked material; and then subjecting the plastically worked material to an ageing treatment at a predetermined temperature for a predetermined time. It has excellent nonmagnetic properties, i.e., low magnetic permeability, since the basic composition of this alloy is mainly nickel. Furthermore, its magnetic permeability is not increased by cold or warm plastic working as in the case of austenitic stainless steel represented by JIS SUS304. It has excellent corrosion resistance, since the composition of the base material contains 30 to 45% (by weight) chromium. Moreover, it can be manufactured at relatively low cost, since the Ni-based alloy composition of base material does not contain any expensive metals.

The method of manufacturing a nonmagnetic high-hardness alloy according to sixth aspect of the present invention can manufacture the alloy exhibiting improvements in properties corresponding to effects of each composition, since the Ni-based alloy composition further contains, by weight %, at least one of: Ti of 3.0% or less, Zr of 3.0% or less, and Hf of 3.0% or less, satisfying the relationship Ti+Zr+Hf of 3.0% or less; Nb of 3.0% or less, Ta of 3.0% or less, and V of 3.0% or less, satisfying the relationship Nb+Ta+V of 3.0% or less; Co of 10% or less; Mo of 10% or less, and W of 10% or less, satisfying the relationship Mo+0.5 W of 10% or less; Cu of 5% or less; B of 0.015% or less; Mg of 0.01% or less; Ca of 0.01% or less; REM (rare earth metal) of 0.1% or less; and Fe of 5% or less.

The term "nonmagnetic property" as herein used means a magnetic permeability of 1.05 or less. The Ni-based alloy composition mainly contains nickel and contains, beside nickel, by weight %, 30 to 45% of Cr, 1.5 to 5.0% of Al, 0.1% or less of C, 2.0% or less of Si, 2.0% or less of Mn, 0.03% or less of P, 0.01% or less of S and unavoidable impurities, and if the ranges as set forth above are maintained, the proportion of any of the metal elements may be varied, or the alloy may contain another elements.

The following are explanations of each component of the nonmagnetic high-hardness alloy according to the present invention and the reason for the limited range of its proportion:

C: 0.1% (by Weight) or Less

C serves as a deoxidizing agent function during melting; and if the material contains any element of the group of Ti, Zr and Hf or the group of Nb, Ta and V, C forms carbides therewith and thereby contributed to preventing any coarsening of crystal grains during the solution treatment and strengthening the grain boundary. The presence of C in excess of 0.1% (by weight) declines strength and toughness. A preferred proportion of C is 0.08% (by weight) or less.

Si: 2.0% (by Weight) or Less

Si is an important component as a deoxidizing element, but as the presence of a large amount of Si decrease strength and toughness, its proportion is limited to 2.0% (by weight) or less. A preferred proportion of Si is 1.0% (by weight) or less.

Mn: 2.0% (by Weight) or Less

Mn is useful as a deoxidizing element like Si, but as its excessive presence decrease strength and toughness, its proportion is limited to 2.0% (by weight) or less. A preferred proportion of Mn is 1.0% (by weight) or less.

P: 0.03% (by Weight) or Less

The segregation of P in the grain boundary lowers hot and cold workability. Accordingly, its proportion is limited to 0.03% (by weight) or less.

S: 0.01% (by Weight) or Less

The segregation of S in the grain boundary also lowers hot and cold workability as in the case of P. Accordingly, its proportion is limited to 0.01% (by weight) or less.

Cr: 30 to 45% (by Weight)

Cr is the principal element forming the α-phase and is an important element, since the composite precipitation of the αCr- and γ'-phases makes it possible to achieve high hardness. Of course, it also contributes to improving corrosion resistance. If its proportion is lower than 30% (by weight), its effectiveness is not fully manifested, but its presence in excess of 45% (by weight) decrease workability. Accordingly, its proportion is from 30 to 45% (by weight). A preferred proportion is from 32 to 42% (by weight).

Al: 1.5 to 5.0% (by Weight)

Al is an important element forming the γ' phase and also serves to enhance high temperature corrosion resistance. Its effectively is not available with its proportion below 1.5% (by weight), while its proportion in excess of 5.0% (by weight) lowers workability. Accordingly, its proportion is from 1.5 to 5.0% (by weight) and preferably from 2.0 to 4.5% (by weight).

Ti: 3.0% (by Weight) or Less, Zr: 3.0% (by Weight) or Less, Hf: 3.0% (by Weight) or Less, and Ti+Zr+Hf: 3.0% (by Weight) or Less Each of Ti, Zr and Hf contributes to a solid solution strengthening of the γ' phase by replacing Al therein and also serves to increase the strength of the alloy. Each of the contents of Ti, Zr and Hf is preferably 3.0% (by weight) or less, since their presence in excess of 3.0% (by weight) lowers workability. Ti is the most effective element among them for improving strength and its more preferred proportion is 2.0% (by weight) or less. Zr and Hf can effectively strengthen the crystal grain boundary by segregation and their optimum proportion is 0.1% (by weight) or less. The total amount of Ti, Zr and Hf is preferably 3.0% (by weight) or less and more preferably 2.0% (by weight) or less.

Nb: 3.0% (by Weight) or Less, Ta: 3.0% (by Weight) or Less, V: 3.0% (by Weight) or Less, and Nb+Ta+V: 3.0% (by Weight) or Less Like Al, Ti and an element of the Hf group, each of Nb, Ta and V contributes to a solid solution strengthening of the γ' phase by replacing Al therein and also serves to increase the strength of the alloy. Each of the contents of Nb, Ta and V is preferably 3.0% (by weight) or less, since their presence in excess of 3.0% (by weight) lowers workability. Nb and Ta are the most effective of those elements and their proportion is preferably 3.0% (by weight) or less and more preferably 2.0% (by weight) or less. The total amount of Nb, Ta and V is preferably 3.0% (by weight) or less and preferably 2.0% (by weight) or less.

Mo: 10% (by Weight) or Less, W: 10% (by Weight) or Less, and Mo+0.5 W: 10% (by Weight) or Less Mo and W can effectively increase strength by a solid solution strengthening. Mo can also effectively enhance corrosion resistance. However, Mo+0.5 W in excess of 10% (by weight) is undesirable, since their presence not only lowers workability and high-temperature corrosion resistance, but also makes the alloy very expensive. Accordingly, each of Mo and W preferably has its proportion limited to 10% (by weight) or less and when they are used together, Mo+0.5 W is preferably limited to 10% (by weight) or less and each preferably has a proportion of 5% (by weight) or less.

Co: 10% (by Weight) or Less

Co can effectively enhance high-temperature strength by a solid solution strengthening and increase the precipitation of the γ' phase. Co is an expensive element and preferably has its proportion limited to 10% (by weight). Its more preferred proportion is 5% (by weight) or less.

Cu: 5% (by Weight) or Less

Cu is an element which is effective for improving cold workability. It can also drastically enhance sulfuric acid corrosion resistance. Its presence in excess of 5% (by weight) lowers hot workability. Accordingly, Cu preferably has its proportion limited to 5% (by weight) or less and more preferably 3% (by weight) or less.

B: 0.015% (by Weight) or Less

B can effectively strengthen the crystal grain boundary by segregation and thereby increase hot workability and creep strength. Its presence in excess of 0.015% (by weight) lowers hot workability and its proportion is preferably limited to 0.005% (by weight) or less.

Mg: 0.01% (by Weight) or Less

Ca: 0.01% (by Weight) or Less

Mg and Ca are elements added to the molten material as deoxidizing and desulfurizing agents and enhance the hot workability of the alloy. Their presence in excess of 0.01% (by weight) lowers hot workability and their proportion are preferably limited to 0.01% (by weight) or less.

REM: 0.1% (by Weight) or Less

REM is effective for improving oxidation resistance at a high temperature and particularly for restraining the separation of closely adhering scale. Its presence in excess of 0.1% (by weight) lowers hot workability and its proportion is preferably limited to 0.1% (by weight) or less.

Fe: 5% (by Weight) or Less

Fe is likely to come from materials for any other element and as it lowers the strength, high-temperature erosion resistance and corrosion resistance of the alloy, its proportion is preferably limited to 5% (by weight) or less.

The ageing treatment has its temperature and time so selected as to ensure that the αCr phase and γ' phase form fine and uniform precipitates in the metal structure. If the ageing temperature is lower than 350° C., no satisfactory precipitate of the αCr phase or γ' phase is formed, and if it exceeds 700° C., not only stain release, but also the coarsening of the precipitations make it impossible to obtain high hardness. Thus, the ageing temperature is preferably selected from 350 to 700° C. and more preferably from 450 to 600° C.

Furthermore, the time period of the ageing treatment is preferably 4 to 24 hour.

The plastic working may be done by swaging, drawing or extrusion. Namely, any plastic working can be applied as far as predetermined working rate in cold or warm working condition.

When a plastic working rate is 15% or more, an adequate high hardness can be obtained by the subsequent ageing treatment. If the working rate is 30% or more, a still greater ageing hardness can be obtained.

The cold or warm plastic working means that its temperature is not of hot working, but is a temperature not relieving the stain produced by plastic working, for example, 700° C. or lower.

EXAMPLES

The present invention is now illustrated in greater detail with reference to Examples and Comparative Examples, but it should be understood that the present invention is not to be construed as being limited thereto.

One embodiment of the present invention will now be described in detail with reference to the drawings. In the following description, the drawings are simplified and do not necessarily represent the exact dimensions.

FIG. 1 is a flow chart illustrating a process for manufacturing a rod product 10 according to certain example of the present invention. The rod product 10 is intended for making a rail, a shaft, a bearing roller, or any parts by appropriate machining, finishing and inspection as required. A raw material shown at 11 in FIG. 1 is, for example, a metallic material having the chemical composition (wt %) of Comparative Material A as shown in Tables 1 and 2. They have a Ni-based alloy composition containing 0.1% or less of C, 2.0% or less of Si, 2.0% or less of Mn, 0.03% or less of P, 0.01% or less of S, 30 to 45% of Cr and 1.5 to 5.0% of Al, all by weight, the balance thereof being composed of unavoidable impurities and nickel, and it may further contain at least one of the elements Ti, Zr, Hf, Nb, Ta, V, Co, Mo, W, Cu, B, Mg, REM and Fe.

Referring to FIG. 1, a 150 kg ingot is, for example, formed from the raw material 11 by vacuum melting (Step 14), is homogenized (Step 16) and is hot forged (Step 18) to make an intermediate product 12 in the form of a rod having a diameter of 70 mm. The intermediate product 12 is subjected to heat treatment 1 under the conditions shown in Table 3 and peeled (Step 20) to have its diameter reduced from 70 mm to 65 mm.

Then, the intermediate product 12 has its surface cleaned by pickling with a molten salt, hydrochloric, sulfuric or fluoronitric acid and coated with a lubricant, such as carbon or molybdenum disulfide, and is plastically worked as by swaging with a working rate of, for instance, 30% to have its diameter reduced from 65 mm to 54 mm.

Heat treatment 2 (Step 26) is given only to a swaged or otherwise plastically worked material under the conditions shown in Table 3. Then, it is finished or inspected (Step 28) as required to give the rod 10. As is obvious from conditions of heat treatment 2, ageing treatment after cold working was given only to Alloys 1 to 20 and Comparative Materials H, J and L.

Experiment Example 1

Tables 1 and 2 show the chemical composition (wt %) of each of the materials employed for verification tests conducted by us. Each of our Developed Alloys 1 to 20 corresponds to the rod 10, Comparative Materials A and B correspond to SUS304 and Comparative Materials G and H correspond to SUH660. Comparative Materials I and J are alloys having a higher phosphorus content than our Developed Alloys and Comparative Materials K and L are alloys having a higher sulfuric content.

Tables 4 and 5 show data for samples formed from our Developed Alloys 1 to 20 and Comparative Materials A to I and K by the steps shown in FIG. 1, including hardness as determined in accordance with JIS Z 2244, corrosion resistance as determined by a salt spray test in accordance with JIS Z 2371 and magnetic permeability μ in a magnetic field having a strength of 100 Oe (oersteds). As is obvious from Tables 4 and 5, all of our Developed Alloys 1 to 20 showed a substantial improvement in hardness by plastic working with a working rate of 30%, while retaining high corrosion resistance and nonmagnetic property. In Tables 4 and 5, the magnetic permeabilities of Comparative Material C (SUS440C), D (SUS630), E (SUJ2) or F (SKD11) could not be measured, since they are all ferromagnetic. No data could be collected from Comparative Material J or L, since they both cracked during plastic working.

Experiment Example 2

Description will now be made of an experiment conducted by us to determine the relations between working rate and hardness (HV) and between ageing conditions and hardness (HV).

Conditions of the Experiment (a) Ageing Treatment:

The ageing of each material was performed by holding it at a temperature of 350 to 800° C. for 16 hours in a furnace in air atmosphere and allowing air cooling.

(b) Testpiece:

Five test pieces of our Developed Alloy 1 were each prepared by swaging rods thereof having a diameter of 65 mm with working rate of 0%, 15%, 30%, 60% or 90%. Their test pieces were subjected to the ageing treatment described above.

(c) Hardness Testing:

Each test piece had its hardness examined by a Vickers hardness tester in accordance with JIS Z2244.

Figure 4:
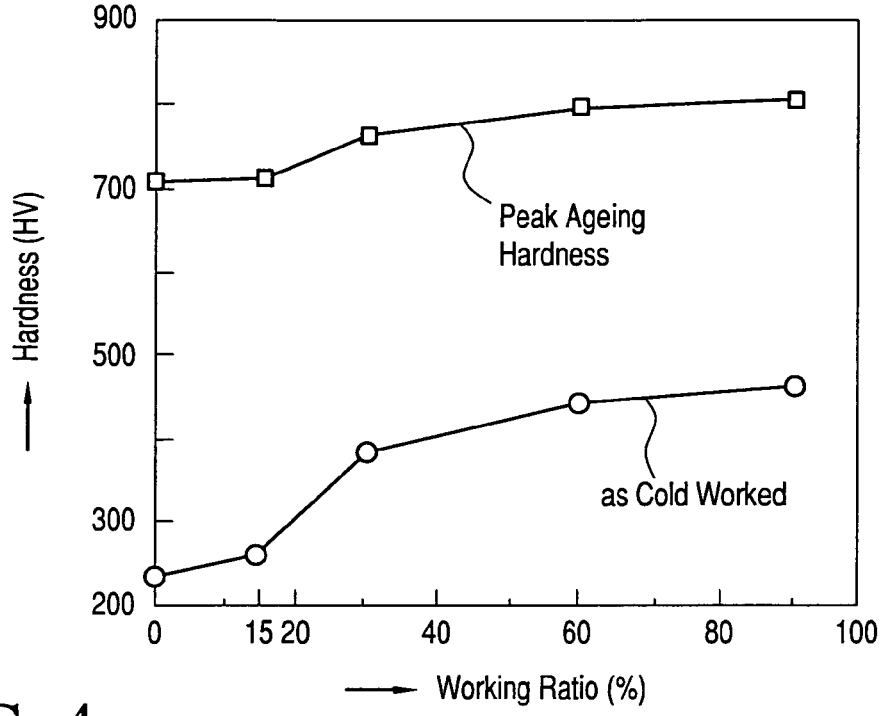
FIG. 4 is a graph showing the hardness (HV) of each sample according to Experiment Example 2 depending on its working rate (%).

FIG. 4 shows the hardness of each test piece depending on the working rate. Each symbol o indicates the hardness of the material as cold rolled and each symbol □ indicates the peak ageing hardness of the material. The hardness as cold rolled increases up to about 450 HV with the working rate. The peak ageing hardness also increases up to about 800 HV with the working rate.

Figure 5:
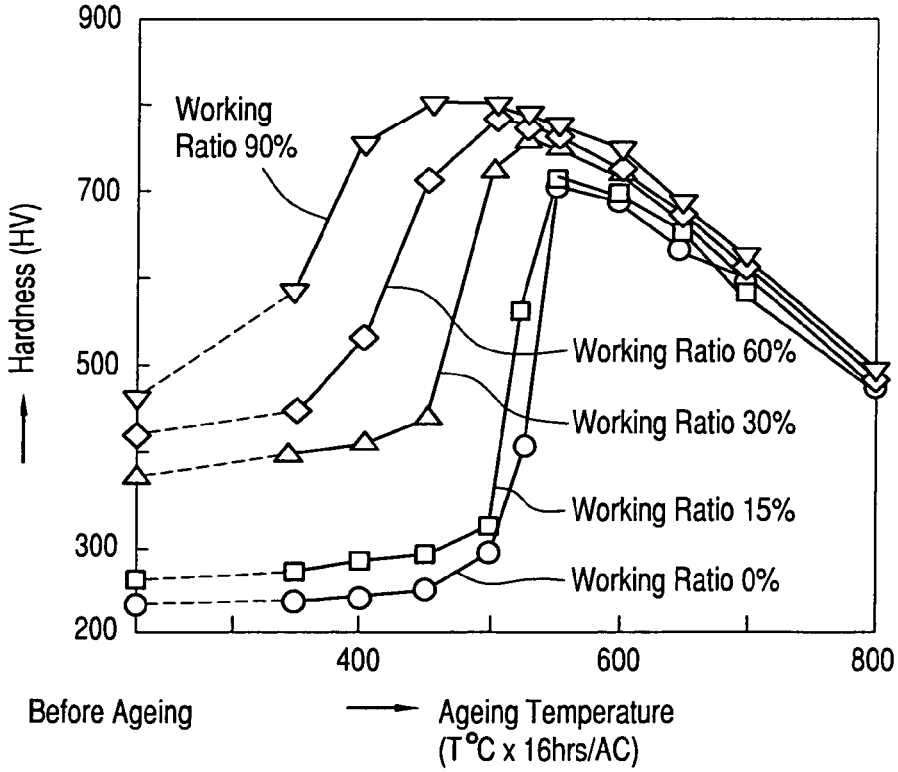
FIG. 5 is a graph showing the hardness of materials having different working rate depending on their ageing temperature.

FIG. 5 shows the hardness of each test piece in relation to its ageing temperature. In FIG. 5, each symbol o indicates the hardness of the material having a working rate of 0%, each symbol □ indicates the hardness of the material having a working rate of 15%, each symbol Δ indicates the hardness of the material having a working rate of 30%, each symbol ◇ indicates the hardness of the material having a working rate of 60% and each symbol ∇ indicates the hardness of the material having a working rate of 90%. Obviously from FIG. 5, a material having a higher working rate acquires a higher hardness by ageing even at a temperature as low as 400° C. The materials having a working rate of 90% acquire a hardness up to about 800 HV by ageing at a temperature of 400 to 500° C. The plastically worked materials have their hardness increased by ageing at a temperature of 350 to 700° C. and particularly by ageing at a preferred temperature of 400 to 650° C.

The materials having a working rate of 60% or 90% acquired a maximum hardness of 800 HV by ageing as shown in FIG. 5. This has not been possible by any method other than ageing after cold rolling. Incidentally, no ageing whatsoever has given such a high level of hardness to any rod of Ni-based alloy as mentioned before.

The Tables 1-5 are shown below. Incidentally, Tables 1 and 2 are a table showing the chemical composition (wt %) of each alloys 1 to 20 and A to L as employed in Experiment Example 1, Table 3 is a table showing the conditions of heat treatment as employed in Experiment Example 1, and Tables 4 and 5 are tables showing, for each of samples formed from alloys 1 to 20 and A to I and K by the steps shown in FIG. 1, its hardness as determined in accordance with JIS Z 2244, its corrosion resistance as determined by a salt spray test in accordance with JIS Z 2371 and its magnetic permeability μ in a magnetic field having a strength of 100 Oe.

TABLE 1

| | | Chemical composition (wt %) | | | | | | | | | | | | |
|---|---|---|---|---|---|---|---|---|---|---|---|---|---|---|
| | | C | Si | Mn | P | S | Ni | Cr | Cu* | Mo* | Fe* | Al | Other elements | JIS designation |
| Developed alloy | 1 | 0.01 | 0.14 | 0.02 | 0.015 | 0.0021 | Bal | 37.9 | — | — | — | 3.81 | | |
| | 2 | 0.09 | 0.11 | 0.06 | 0.003 | 0.0096 | Bal | 38.1 | — | — | — | 1.67 | | |
| | 3 | 0.04 | 1.92 | 0.05 | 0.018 | 0.0018 | Bal | 38.3 | — | — | — | 3.54 | | |
| | 4 | 0.05 | 0.22 | 1.95 | 0.012 | 0.0077 | Bal | 37.7 | — | — | — | 3.86 | | |
| | 5 | 0.06 | 0.15 | 0.14 | 0.016 | 0.0034 | Bal | 30.5 | — | — | — | 3.91 | | |
| | 6 | 0.04 | 0.20 | 0.18 | 0.009 | 0.0041 | Bal | 44.7 | — | — | — | 3.74 | | |
| | 7 | 0.06 | 0.18 | 0.11 | 0.011 | 0.0012 | Bal | 37.9 | — | — | — | 4.88 | | |
| | 8 | 0.05 | 0.17 | 0.15 | 0.014 | 0.0022 | Bal | 38.2 | 0.91 | 0.22 | 0.15 | 3.20 | Ti: 2.85<br>Zr: 0.02 | |
| | 9 | 0.02 | 0.20 | 0.18 | 0.015 | 0.0045 | Bal | 39.0 | 0.02 | 0.44 | 0.11 | 3.64 | Ti: 1.36<br>Hf: 0.06 | |

TABLE 1-continued

| | Chemical composition (wt %) | | | | | | | | | | | | |
|---|---|---|---|---|---|---|---|---|---|---|---|---|---|
| | C | Si | Mn | P | S | Ni | Cr | Cu* | Mo* | Fe* | Al | Other elements | JIS designation |
| 10 | 0.02 | 0.34 | 0.14 | 0.007 | 0.0052 | Bal | 37.5 | 0.20 | 0.21 | 0.12 | 3.92 | Nb: 0.2<br>Ta: 0.2<br>V: 0.3 | |
| 11 | 0.06 | 0.02 | 0.25 | 0.014 | 0.0088 | Bal | 38.2 | 0.25 | 0.15 | 0.23 | 3.77 | Co: 9.67 | |
| 12 | 0.04 | 0.34 | 0.05 | 0.012 | 0.0014 | Bal | 39.2 | 0.56 | 9.23 | 0.22 | 3.82 | | |
| 13 | 0.05 | 0.52 | 0.72 | 0.006 | 0.0082 | Bal | 34.5 | 0.22 | 0.22 | 0.34 | 3.65 | W: 8.88 | |
| 14 | 0.04 | 0.10 | 0.13 | 0.004 | 0.0022 | Bal | 37.6 | 0.11 | 7.23 | 0.21 | 3.79 | W: 4.45 | |
| 15 | 0.04 | 0.05 | 0.15 | 0.009 | 0.0020 | Bal | 38.1 | 4.11 | 0.04 | 0.11 | 3.89 | | |
| 16 | 0.02 | 0.06 | 0.11 | 0.010 | 0.0023 | Bal | 36.8 | 0.02 | 0.10 | 0.06 | 3.65 | B: 0.012 | |
| 17 | 0.05 | 0.14 | 0.12 | 0.006 | 0.0032 | Bal | 37.2 | 0.34 | 0.22 | 0.42 | 4.11 | Mg: 0.008 | |
| 18 | 0.07 | 0.09 | 0.10 | 0.012 | 0.0021 | Bal | 35.9 | 0.88 | 0.57 | 0.07 | 3.88 | Ca: 0.005 | |
| 19 | 0.04 | 0.11 | 0.21 | 0.005 | 0.0055 | Bal | 38.2 | 0.91 | 0.21 | 0.52 | 3.77 | REM: 0.08 | |
| 20 | 0.07 | 1.20 | 0.23 | 0.003 | 0.0044 | Bal | 38.1 | 0.13 | 0.11 | 4.75 | 3.81 | | |

The sign "—" means that the element is not analyzed.

TABLE 2

| | | Chemical composition (wt %) | | | | | | | | | | | | |
|---|---|---|---|---|---|---|---|---|---|---|---|---|---|---|
| | | C | Si | Mn | P | S | Ni | Cr | Cu* | Mo* | Fe* | Al | Other elements | JIS designation |
| Comparative material | A | 0.05 | 0.75 | 0.78 | 0.032 | 0.018 | 8.01 | 18.05 | 0.10 | 0.04 | Bal | 0.05 | | SUS304 |
| | B | | | | | | | | | | | | | |
| | C | 1.02 | 0.23 | 0.32 | 0.036 | 0.021 | 0.24 | 16.61 | 0.10 | 0.36 | Bal | 0.08 | | SUS440C |
| | D | 0.04 | 0.33 | 0.45 | 0.023 | 0.019 | 4.60 | 15.72 | 3.45 | 0.03 | Bal | 0.04 | Nb: 0.28 | SUS630 |
| | E | 0.99 | 0.23 | 0.42 | 0.019 | 0.017 | 0.06 | 1.48 | 0.07 | 0.02 | Bal | 0.05 | | SUJ2 |
| | F | 1.41 | 0.32 | 0.38 | 0.012 | 0.022 | 0.21 | 12.52 | 0.10 | 1.00 | Bal | 0.04 | V: 0.3 | SKD11 |
| | G | 0.05 | 0.50 | 0.71 | 0.025 | 0.016 | 26.06 | 15.02 | 0.06 | 1.32 | Bal | 0.19 | Tl: 2.0 | SUH660 |
| | H | | | | | | | | | | | | | |
| | I | 0.02 | 0.13 | 0.05 | 0.033 | 0.0028 | Bal | 38.0 | — | — | — | 3.77 | | |
| | J | | | | | | | | | | | | | |
| | K | 0.03 | 0.11 | 0.02 | 0.005 | 0.0143 | Bal | 37.8 | — | — | — | 3.84 | | |
| | L | | | | | | | | | | | | | |

The sign "—" means that the element is not analyzed.

TABLE 3

| | | Conditions of heat treatment 1 | Working rate (%) | Conditions of heat treatment 2 | JIS designation |
|---|---|---|---|---|---|
| Developed alloy | 1-20 | 1150° C. × 1 hr, water cool + 550° C. × 16 hr0, air cool | 0 | | |
| | | 1150° C. × 1 hr, water cool | 30 | 550° C. × 16 hr, air cool | |
| Comparative material | A | 1050° C. × 1 hr, water cool | 0 | | SUS304 |
| | B | | 30 | | |
| | C | 1050° C. × 1 hr, Oil cool + (−196° C. × 1 hr) + 180° C. × 2 hr, air cool | 0 | | SUS440C |
| | D | 1038° C. × 1 hr, air cool + 482° C. × 1 hr, air cool | 0 | | SUS630 |
| | E | 800° C. × 1 hr, water cool + 180° C. × 2 hr, air cool | 0 | | SUJ2 |
| | F | 1030° C. × 1 hr, air cool + 200° C. × 1 hr, air cool | 0 | | SKD11 |
| | G | 980° C. × 1 hr, Oil cool + 720° C. × 16 hr, air cool | 0 | | SUH660 |
| | H | 980° C. × 1 hr, Oil cool | 30 | 600° C. × 16 hr, air cool | |
| | I | 1150° C. × 1 hr, water cool + 550° C. × 16 hr, air cool | 0 | | |
| | J | 1150° C. × 1 hr, water cool | 30 | 550° C. × 16 hr, air cool | |
| | K | 1150° C. × 1 hr, water cool + 550° C. × 16 hr, air cool | 0 | | |
| | L | 1150° C. × 1 hr, water cool | 30 | 550° C. × 16 hr, air cool | |

TABLE 4

| | | Working rate (%) | Hardness (HV) | Corrosion resistance | Perme-ability | Remarks |
|---|---|---|---|---|---|---|
| Developed alloy | 1 | 0 | 705 | No rusting | 1.003 | |
| | | 30 | 730 | No rusting | 1.003 | |
| | 2 | 0 | 678 | No rusting | 1.003 | |
| | | 30 | 723 | No rusting | 1.003 | |
| | 3 | 0 | 698 | No rusting | 1.003 | |
| | | 30 | 732 | No rusting | 1.003 | |

TABLE 4-continued

| | | Working rate (%) | Hardness (HV) | Corrosion resistance | Perme-ability | Remarks |
|---|---|---|---|---|---|---|
| | 4 | 0 | 711 | No rusting | 1.003 | |
| | | 30 | 762 | No rusting | 1.003 | |
| | 5 | 0 | 710 | No rusting | 1.003 | |
| | | 30 | 755 | No rusting | 1.003 | |
| | 6 | 0 | 714 | No rusting | 1.003 | |
| | | 30 | 751 | No rusting | 1.003 | |

TABLE 4-continued

| | Working rate (%) | Hardness (HV) | Corrosion resistance | Perme-ability | Remarks |
|---|---|---|---|---|---|
| 7 | 0 | 709 | No rusting | 1.003 | |
| | 30 | 751 | No rusting | 1.003 | |
| 8 | 0 | 711 | No rusting | 1.003 | |
| | 30 | 745 | No rusting | 1.003 | |
| 9 | 0 | 699 | No rusting | 1.003 | |
| | 30 | 738 | No rusting | 1.003 | |
| 10 | 0 | 711 | No rusting | 1.003 | |
| | 30 | 744 | No rusting | 1.003 | |
| 11 | 0 | 709 | No rusting | 1.003 | |
| | 30 | 742 | No rusting | 1.003 | |
| 12 | 0 | 707 | No rusting | 1.003 | |
| | 30 | 754 | No rusting | 1.003 | |
| 13 | 0 | 705 | No rusting | 1.003 | |
| | 30 | 747 | No rusting | 1.003 | |
| 14 | 0 | 702 | No rusting | 1.003 | |
| | 30 | 754 | No rusting | 1.003 | |
| 15 | 0 | 698 | No rusting | 1.003 | |
| | 30 | 739 | No rusting | 1.003 | |
| 16 | 0 | 701 | No rusting | 1.003 | |
| | 30 | 741 | No rusting | 1.003 | |
| 17 | 0 | 719 | No rusting | 1.003 | |
| | 30 | 754 | No rusting | 1.003 | |
| 18 | 0 | 697 | No rusting | 1.003 | |
| | 30 | 739 | No rusting | 1.003 | |
| 19 | 0 | 700 | No rusting | 1.003 | |
| | 30 | 742 | No rusting | 1.003 | |
| 20 | 0 | 698 | No rusting | 1.003 | |
| | 30 | 734 | No rusting | 1.003 | |

TABLE 5

| | | Working rate (%) | Hardness (HV) | Corrosion resistance | Permeability | Remarks |
|---|---|---|---|---|---|---|
| Comparative material | A | 0 | 182 | Partial rusting | 1.004 | |
| | B | 30 | 320 | Partial rusting | 4.011 | |
| | C | 0 | 697 | Total rusting | — | Ferromagnetism |
| | D | 0 | 402 | Partial rusting | — | Ferromagnetism |
| | E | 0 | 775 | Total rusting | — | Ferromagnetism |
| | F | 0 | 620 | Total rusting | — | |
| | G | 0 | 315 | No rusting | 1.007 | |
| | H | 30 | 380 | No rusting | 1.052 | |
| | I | 0 | 701 | No rusting | 1.003 | |
| | J | 30 | — | — | — | Cracked |
| | K | 0 | 703 | No rusting | 1.003 | |
| | L | 30 | — | — | — | Cracked |

While the present invention has been described in detail and with reference to specific embodiments thereof, it will be apparent to one skilled in the art that various changes and modifications can be made therein without departing from the spirit and scope thereof.

The present application is based on Japanese Patent Application No. 2005-59279 filed on Mar. 3, 2005 and 2006-12931 filed on Jan. 20, 2006, and the contents thereof are incorporated herein by reference.

What is claimed is:

1. A method for producing nonmagnetic high-hardness alloy, comprising;

preparing a material having Ni-based alloy composition consisting of; by weight %, C of 0.1% or less:

Si of 2.0% or less;

Mn of 2.0% or less;

P of 0.03% or less;

S of 0.01% or less;

Cr of 36.8 to 45%;

Al of 1.5 to 5.0%; and a balance of unavoidable impurities and Ni;

subjecting the material to cold or warm plastic working by swaging, drawing or extrusion, with predetermined working rate to obtain a plastically worked material; and then subjecting the plastically worked material to direct ageing treatment at predetermined temperature for predetermined time.

2. The method of claim 1, which further comprises subjecting the material to a hot working before subjecting the material to cold or warm plastic working by swaging, drawing or extrusion.

3. A method for producing nonmagnetic high-hardness alloy, comprising;

preparing a material having Ni-based alloy consisting of; by weight %,

C of 0.1% or less:

Si of 2.0% or less;

Mn of 2.0% or less;

P of 0.03% or less;

S of 0.01% or less;

Cr of 36.8 to 45%;

Al of 1.5 to 5.0%;

wherein the Ni-based alloy composition further consists, by weight %, at least one of:

Ti of 3.0% or less, Zr of 3.0% or less, and Hf of 3.0% or less, satisfying the relationship Ti+Zr+Hf of 3.0% or less;

Co of 10% or less;

Mo of 10% or less, and W of 10% or less, satisfying the relationship Mo+0.5 W of 10% or less;

Cu of 5% or less;

B of 0.015% or less;

Mg of 0.01% or less;

Ca of 0.01% or less;

REM (rare earth metal) of 0.1% or less; and

Fe of 5% or less;

and a balance of unavoidable impurities and Ni;

subjecting the material to cold or warm plastic working by swaging, drawing or extrusion, with predetermined working rate to obtain a plastically worked material; and then subjecting the plastically worked material to direct ageing treatment at predetermined temperature for predetermined time.

4. The method of claim 3, wherein the ageing temperature is from 350° C. to 700° C.

5. The method of claim 4, wherein the ageing temperature is from 400° C. to 650° C.

6. The method of claim 5, wherein the ageing temperature is from 450° C. to 600° C.

7. The method of claim 6, wherein the working rate is 15% or more.

8. The method of claim 7, wherein the working rate is 30% or more.

9. The method of claim 3, wherein the alloy has a hardness of at least 700 Hv.

10. The method of claim 3, which further comprises subjecting the material to a hot working before subjecting the material to cold or warm plastic working by swaging, drawing or extrusion.

11. The method of claim 3, wherein the alloy is formed into a rod.

12. The method of claim 11, wherein the working rate is 60% to 90%.

* * * * *